US008639141B2

(12) United States Patent
Matsumoto

(10) Patent No.: US 8,639,141 B2
(45) Date of Patent: Jan. 28, 2014

(54) IMAGE FORMING APPARATUS

(75) Inventor: Jun Matsumoto, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 13/109,282

(22) Filed: May 17, 2011

(65) Prior Publication Data

US 2011/0293306 A1 Dec. 1, 2011

(30) Foreign Application Priority Data

May 28, 2010 (JP) ..... 2010-122726

(51) Int. Cl.
*G03G 15/16* (2006.01)

(52) U.S. Cl.
USPC ..... 399/66

(58) Field of Classification Search
USPC ..... 399/66, 71
See application file for complete search history.

(56) References Cited

U.S. PATENT DOCUMENTS

| | | | | |
|---|---|---|---|---|
| 5,671,464 | A | 9/1997 | Kubota | |
| 5,822,648 | A | 10/1998 | Mohri | |
| 7,085,517 | B2 | 8/2006 | Sameshima | |
| 7,840,148 | B2 * | 11/2010 | Tanaka et al. | 399/66 |
| 2003/0202818 | A1 | 10/2003 | Sameshima | |
| 2004/0165902 | A1 * | 8/2004 | Matsuura | 399/66 |
| 2005/0025536 | A1 * | 2/2005 | Gross et al. | 399/316 |
| 2009/0003865 | A1 * | 1/2009 | Endou et al. | 399/66 |

FOREIGN PATENT DOCUMENTS

| | | | |
|---|---|---|---|
| JP | 2002-99154 | A | 4/2002 |
| JP | 2004-118019 | A | 4/2004 |
| JP | 2004-334120 | A | 11/2004 |
| JP | 03-841147 | B2 | 11/2006 |
| JP | 2007-164106 | A | 6/2007 |
| JP | 2007-225807 | A | 9/2007 |

OTHER PUBLICATIONS

Machine translation of Shimura (JP 2004 4118019 A, pub date: Apr. 15, 2004) listed in IDS.*

Communication dated Sep. 15, 2011, forwarding a European Search Report dated Sep. 7, 2011, in European Application No. 11167391.9-2209.

Korean Office Action dated Oct. 11, 2013, in related Korean Patent Application No. 9-5-2013-070216398.

* cited by examiner

*Primary Examiner* — Walter Lindsay, Jr.
*Assistant Examiner* — Frederick Wenderoth
(74) *Attorney, Agent, or Firm* — Fitzpatrick, Cella, Harper & Scinto

(57) ABSTRACT

An image forming apparatus includes an image bearing member for bearing a toner image, a rotatable intermediary transfer member onto which the toner image is to be primary-transferred from the image bearing member, a contact member movable toward and away from the intermediary transfer member, a voltage applying unit for applying a voltage to the contact member, a current detecting circuit for detecting a current passing through the contact member, and a control portion for effecting control so that the contact member is in contact with or separated from the intermediary transfer member. The control portion can operate a measuring mode in which a contact time required to bring the contact member into contact with the intermediary transfer member is calculated by applying an initial voltage to the contact member, then by outputting a contact instruction signal to move the contact member to be in contact with the intermediary transfer member, and then by measuring a time from output of the contact instruction signal until the current detecting circuit detects a predetermined current value.

12 Claims, 8 Drawing Sheets

IMAGE FORMING APPARATUS

FIELD OF THE INVENTION AND RELATED ART

The present invention relates to an image forming apparatus, principally employing an electrophotographic process, such as a color laser printer, a color copying machine or a color facsimile machine.

The image forming apparatus employing the electrophotographic process forms an image by developing a latent image on a photosensitive drum with toner which is a developer and then by transferring and fixing the developed latent image on a recording material such as a print sheet. In such an image forming apparatus, in order to form a color image in particular, a constitution in which toner images of a plurality of colors (yellow, magenta, cyan and black) are primary-transferred superposedly onto an intermediary transfer belt and thereafter are collectively secondary-transferred onto the recording material has been generally known. As the image forming apparatus employing the intermediary transfer belt, a rotary-type image forming apparatus in which a secondary transfer member has been separated from the intermediary transfer belt during the superposition of the toner images of the plurality of colors and is contacted to the intermediary transfer belt with timing of execution of the secondary transfer has been conventionally known.

Further, as a method of collecting residual toner remaining on the intermediary transfer belt without being transferred onto the recording material, a method in which the residual toner has been conventionally charged electrically by a cleaning charging member and then the charged residual toner is moved onto the photosensitive drum and is collected has been conventionally known. This cleaning charging member is not required to be contacted to the intermediary transfer belt when the residual toner is not charged and therefore in the conventional rotary-type image forming apparatus, a image forming apparatus, a constitution in which the cleaning charging member is separated from the intermediary transfer belt when there is no need to effect the cleaning has been employed.

In Japanese Laid-Open Patent Application (JP-A) 2002-99154, a constitution in which the secondary transfer member and the cleaning charging member are contacted to and separated from the intermediary transfer belt by a single cam and its transmission means has been disclosed. Further, a method in which whether the secondary transfer member and the cleaning charging member are in a contact secondary transfer or in a separated secondary transfer with respect to the intermediary transfer belt is detected has been disclosed in JP-A 2004-118019. In JP-A 2004-118019, as a method of discriminating the contact state and the separated state between the secondary transfer member and the intermediary transfer belt, a method in which the contact state and the separated state are discriminated by applying a voltage to the secondary transfer member when the secondary transfer member is contacted to or separated from the intermediary transfer belt and then by detecting a value of a current passing through the secondary transfer member has been proposed.

However, in JP-A 2004-118019, even when the contact state and the separated state can be detected, a time required to complete the contact from the separated state or a time required to complete the separation from the contact state cannot be accurately detected. Therefore, in the case where the secondary transfer member or the cleaning charging member is contacted to a non-image region on the intermediary transfer belt, there is a need to consider a variation in time required to complete the contact to and separation from the intermediary transfer belt.

The consideration of the variation means that a time which is not less than the time required to actually complete the contact to and separation from the intermediary transfer belt is ensured and that a length of the non-image region on the intermediary transfer belt is increased. Further, in order that the voltage to be applied to the secondary transfer member or the cleaning charging member is caused to reach a predetermined voltage value, it takes certain time. For that reason, in a constitution in which the variation in contact time every product is taken into consideration and the voltage is increased after the secondary transfer member or the cleaning charging member is contacted to the intermediary transfer belt with reliability, a rise time of the voltage in the non-image region is needed. That is, correspondingly to the voltage rise time, the length of the non-image region is increased. In the case where the variation in time required to complete the contact or in voltage rise time was large, there was a need to set the length of the non-image region, on the assumption of the case where the above variation is maximum, so as to fall within a possible non-image region with respect to a circumferential direction of the intermediary transfer belt. As a result, a circumferential length of the intermediary transfer belt itself is required to be increased, thus leading to a problem of increases in size and cost of a main assembly of the image forming apparatus.

SUMMARY OF THE INVENTION

The present invention has been accomplished in view of the above circumstances. A principal object of the present invention is to provide an image forming apparatus, including a contact and separation member for moving a secondary transfer member, a cleaning charging member and the like toward and away from an intermediary transfer member, capable of decreasing a circumferential length of the intermediary transfer member without increasing a length of a non-image region formed on the intermediary transfer member.

According to an aspect of the present invention, there is provided an image forming apparatus comprising:

an image bearing member for bearing a toner image;

a rotatable intermediary transfer member onto which the toner image is to be primary-transferred from the image bearing member;

a contact member movable toward and away from the intermediary transfer member;

a voltage applying unit for applying a voltage to the contact member;

a current detecting circuit for detecting a current passing through the contact member to which the voltage is applied by the voltage applying unit; and a control portion for effecting control so that the contact member is contacted to or separated from the intermediary transfer member, wherein the control portion is capable of executing an operation in a measuring mode in which a contact time required to bring the contact member into contact to the intermediary transfer member is calculated, on the basis of a change in current detected by the current detecting circuit, when the contact member to which an initial voltage is applied by the voltage applying unit is contacted to the intermediary transfer member by being moved from a separated state so as to be contacted to the intermediary transfer member, and wherein the control portion brings, during image formation, the contact member into contact to a non-image region on the intermediary transfer member on the basis of the contact time.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 1A:
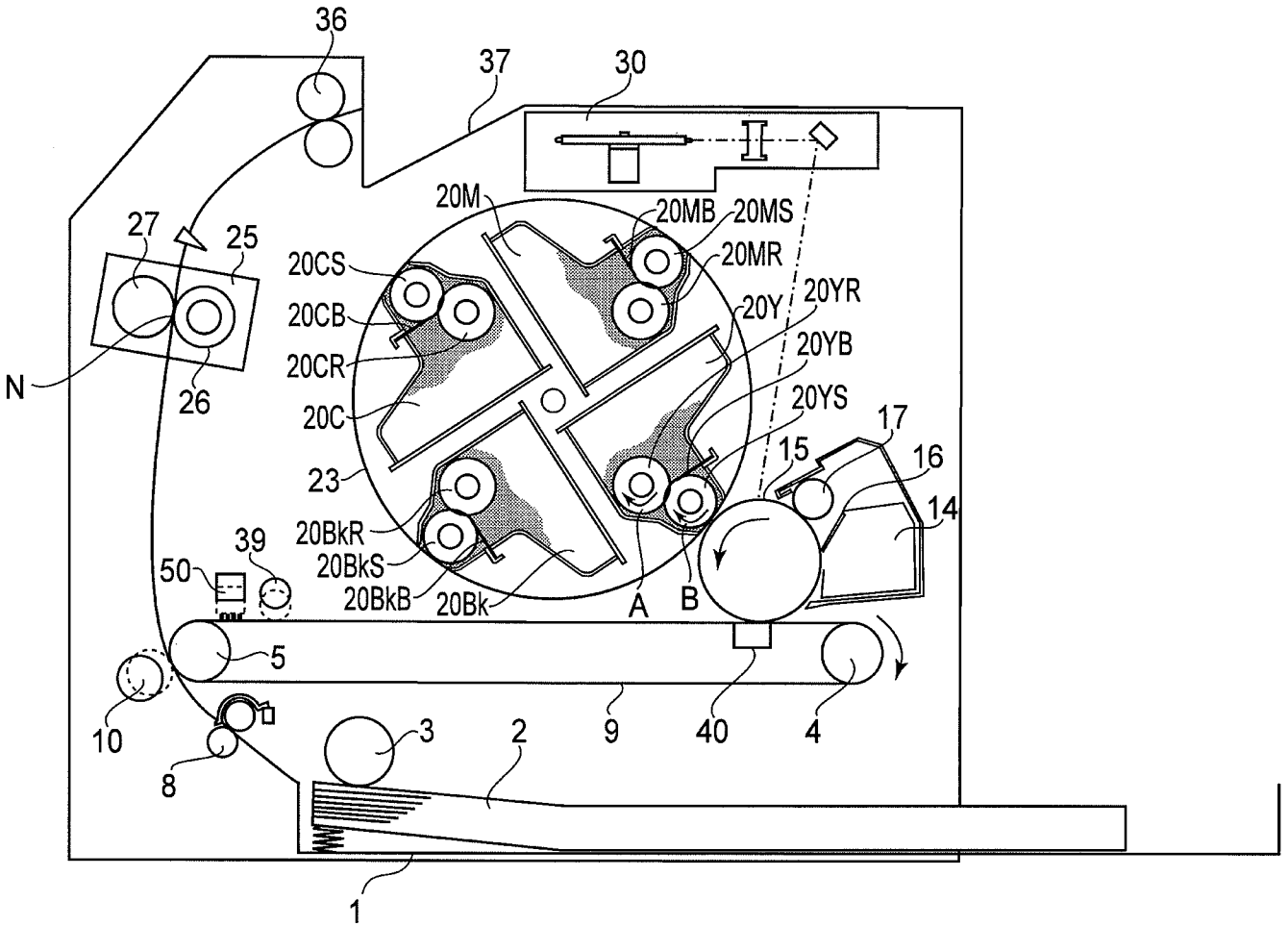
FIG. 1A is a sectional view showing a general arrangement of an image forming apparatus.

With reference to FIG. 1A, a schematic structure of an image forming apparatus and a series of image forming operations will be described. FIG. 1A is a sectional view showing a general arrangement of a rotary-type color image forming apparatus.

During image formation on a recording material 2, the image forming apparatus rotates a sheet feeding roller 3 to feed and convey one sheet of the recording material 2 stacked in a cassette 1 to a registration roller 8 and is on stand-by until an image is formed on an endless intermediary transfer belt 9 as a rotatable intermediary transfer member. In order to form the image, a photosensitive drum 15 which is an image bearing member for forming an electrostatic latent image is surface-charged uniformly by a charging roller 17 and is exposed to light depending on an image signal to form the electrostatic latent image for a yellow image by a laser scanner 30 for forming the electrostatic latent image on the photosensitive drum 15. A yellow developing device 20Y sends toner to an application roller 20YR by a mechanism for sending the toner contained in a container. Then, the toner is applied in a thin layer on an outer peripheral surface of a developing roller 20YS rotating in an arrow B direction by the application roller 20YR rotating in an arrow A direction and a developing blade 20YB press-contacted to the outer peripheral surface of the developing roller 20YS, so that the toner is supplied with electric charge (triboelectrically charged). The electrostatic latent image formed on the photosensitive drum 15 is developed with the toner by applying a developing voltage to the developing roller 20YS opposing the photosensitive drum 15 on which the electrostatic latent image is formed. A voltage of an opposite polarity to the charge polarity of the toner is applied to a toner image formed on the photosensitive drum 15 by applying the voltage to a primary transfer pad 40 which is a primary transfer member, so that the toner image on the develop 15 is primary-transferred onto the intermediary transfer belt 9.

When the yellow toner image is primary-transferred onto the intermediary transfer belt 9, a developing (device) holding unit 23 is rotated, so that a magenta developing device 20M for effecting subsequent image formation is stopped at a developing position at which the image formation is to be effected on the photosensitive drum 15. The rotatable developing holding unit 23 holds the respective developing devices and can be rotated. A magenta toner image is formed by charging and exposing the photosensitive drum 15 to form the electrostatic latent image in the same manner as in the case of the yellow toner image and is primary-transferred onto the intermediary transfer belt 9. Then, cyan and black electrostatic latent image formation, development and primary onto the intermediary transfer belt 9 are effected by a cyan developing device 20C and a black developing device 20Bk to form a color image by multiple transfer on the toner images of four colors of yellow, magenta, cyan and black onto the intermediary transfer belt 9. The constitutions of the magenta developing device 20M, the cyan developing device 20C and the black developing device 20Bk are the same as that of the yellow developing device and therefore will be omitted from description. After the color image is formed on the intermediary transfer belt 9, the image forming apparatus conveys the recording material 2, which has been kept on stand-by at the develop of the registration roller 8, to a secondary transfer portion.

Figure 1B:
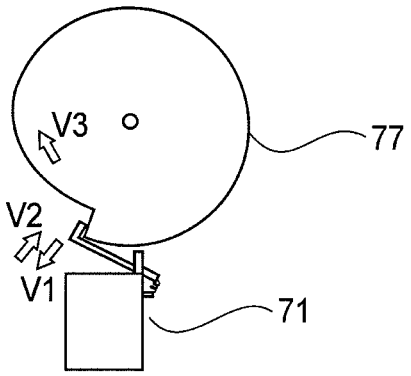
FIG. 1B is an illustration of a cam member connected to a contact and separation mechanism for a secondary transfer roller.

The secondary transfer portion includes a secondary transfer roller 10 which is a secondary transfer member capable of being contacted to and separated from the intermediary transfer belt 9 and includes a driving roller 5 which is connected to a driving device (not shown) including a motor, a gear and the like and which is configured to rotationally drive the intermediary transfer belt 9. The driving roller 5 is also a secondary transfer opposite roller 5 which opposes the secondary transfer roller 10. FIG. 1B shows a cam member 77 connected to a contact and separation mechanism for the secondary transfer roller 10. The secondary transfer roller 10 can be contacted to and separated from the intermediary transfer belt 9, as shown in FIG. 1A as a solid line state (separated state) and a broken line state (contact state), by rotating the cam member 77. The secondary transfer roller 10 is a contact member capable of being contacted to and separated from the intermediary transfer belt 9. In order to contact the secondary transfer roller 10 to the intermediary transfer belt 9, a clutch of an electromagnetic solenoid 71 is disconnected (arrow V1 direction) by turning on the electromagnetic solenoid 71 by a contact instruction signal sent from a CPU 85 described later. As a result, the cam member 77 connected to the contact and separation mechanism for the secondary transfer roller starts to move (arrow V3 direction), so that the secondary transfer roller 10 is contacted to the intermediary transfer belt 9. Then, the electromagnetic solenoid 71 is turned on again and thus the cam member 77 starts to move in an arrow V2 direction, so that the secondary transfer roller 10 is separated from the intermediary transfer belt 9. Further, during the multiple transfer of the toner images of the respective colors onto the intermediary transfer belt 9, the secondary transfer roller 10 is located at the position indicated by the solid line in FIG. 1A and is separated from the intermediary transfer belt 9 so as not to disturb the toner images formed on the intermediary transfer belt 9 by contact to the toner images.

After the toner images of the respective colors are completely transferred onto the intermediary transfer belt 9, the secondary transfer roller 10 is moved to the position indicated by the broken line in FIG. 1A, i.e., is contacted to the intermediary transfer belt 9, by being timed to timing of the secondary transfer of the image onto the recording material 2. The recording material 2 is contacted to the intermediary transfer belt 9 by the secondary transfer roller 10 and the secondary transfer opposite roller 5, and by applying the voltage of the opposite polarity to the charge polarity of the toner to the secondary transfer roller 10, the color toner images on the intermediary transfer belt 9 are transferred onto the recording material 2. During the contact to the intermediary transfer belt 9, there is a need to contact the secondary transfer roller 10 to a non-image region on the intermediary transfer belt 9 by sufficiently considering the variation in time required for the contact in order not to disturb a toner image region on the intermediary transfer belt 9. The non-image region is a region in which the toner image is not transferred from the photosensitive drum 15 with respect to a rotational direction of the intermediary transfer belt 9. The non-image region is located between a trailing end of the toner image transferred on the intermediary transfer belt 9 and a leading end of a subsequent toner image. Further, when the secondary transfer roller 10 is contacted to the intermediary transfer belt 9 in a secondary transfer in which the secondary transfer voltage is applied to the secondary transfer roller 10, electric discharge occurs between the secondary transfer roller 10 and the intermediary transfer belt 9, so that there is a possibility that the current flows from the secondary transfer roller 10 into the intermediary transfer belt 9 in a large amount.

After the color image is transferred from the intermediary transfer belt 9 onto the recording material 2, a cleaning unit is contacted to the intermediary transfer belt 9. As the cleaning unit, in this embodiment, a cleaning brush 50 and a cleaning charging roller 39 are provided. The cleaning brush 50 (hereinafter referred to as "ICL brush 50") uniformly disperse residual toner remaining on the intermediary transfer belt 9. The cleaning charging roller 39 (hereinafter referred to as "ICL roller 39") electrically charges the residual toner dispersed by the ICL brush 50 to the opposite polarity to the toner charge polarity during the development. The ICL brush 50 and the ICL roller 39 are contact members which are to be contacted to and separated from the intermediary transfer belt 9 as shown in FIG. 1A as a solid line state (separated state) and a broken line state (contact state). Further, similarly as in the case of the secondary transfer roller 10, the ICL brush 50 and the ICL roller 39 are also needed to be contacted to the non-image region on the intermediary transfer belt 9 in sufficient consideration of the variation in time required for the contact and in rise time. When the charging of the residual toner is completed, the ICL brush 50 and the ICL roller 39 are separated from the intermediary transfer belt 9. Incidentally, in the case where the image formation is continuously effected, during the charging of the residual toner by the contact of the ICL brush 50 and the ICL roller 39 with the intermediary transfer belt 9, a subsequent yellow image is formed on the photosensitive drum 15. The formed yellow image is primary-transferred onto the intermediary transfer belt 9 and when the yellow image transferred on the intermediary transfer belt 9 passes through contact positions with the ICL brush 50 and the ICL roller 39, the ICL brush 50 and the ICL roller 39 are separated from the intermediary transfer belt 9.

The residual toner charged by the ICL roller 39 is electrostatically moved to the photosensitive drum 15 at the primary transfer portion where the photosensitive drum 15 and the intermediary transfer belt 9 are contacted to each other, and then is collected in a cleaning container 14 by a cleaning blade 16. Further, this residual toner and the yellow toner (first color toner) for a subsequent image are crossed at the primary transfer nip (portion), so that the movement of the residual toner to the photosensitive drum 15 and the primary transfer of the yellow toner image from the photosensitive drum 15 onto the intermediary transfer belt 9 are performed simultaneously.

The recording material 2 is, after being separated from the intermediary transfer belt 9, conveyed to a fixing portion 25 and is fixed at a fixing nip N between a pressing roller 27 and a fixing roller 26. Further, the recording material 2 is discharged on a sheet discharge tray 37 at an upper portion of a main assembly (of the image forming apparatus) via a sheet discharging roller 36 with an image surface facing downward, so that the image forming operation is completed.

Figure 2B:
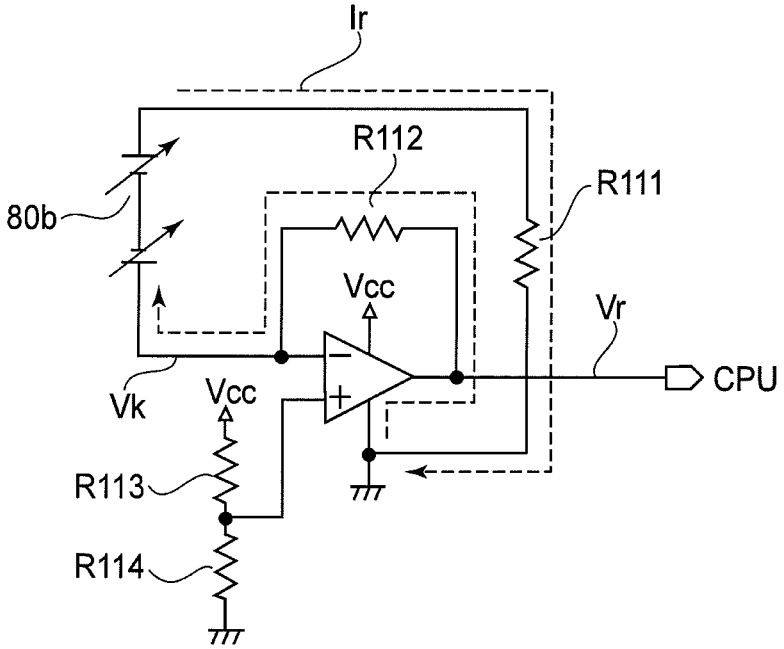
FIG. 2B is a schematic view showing a current detecting circuit.
Figure 2A:
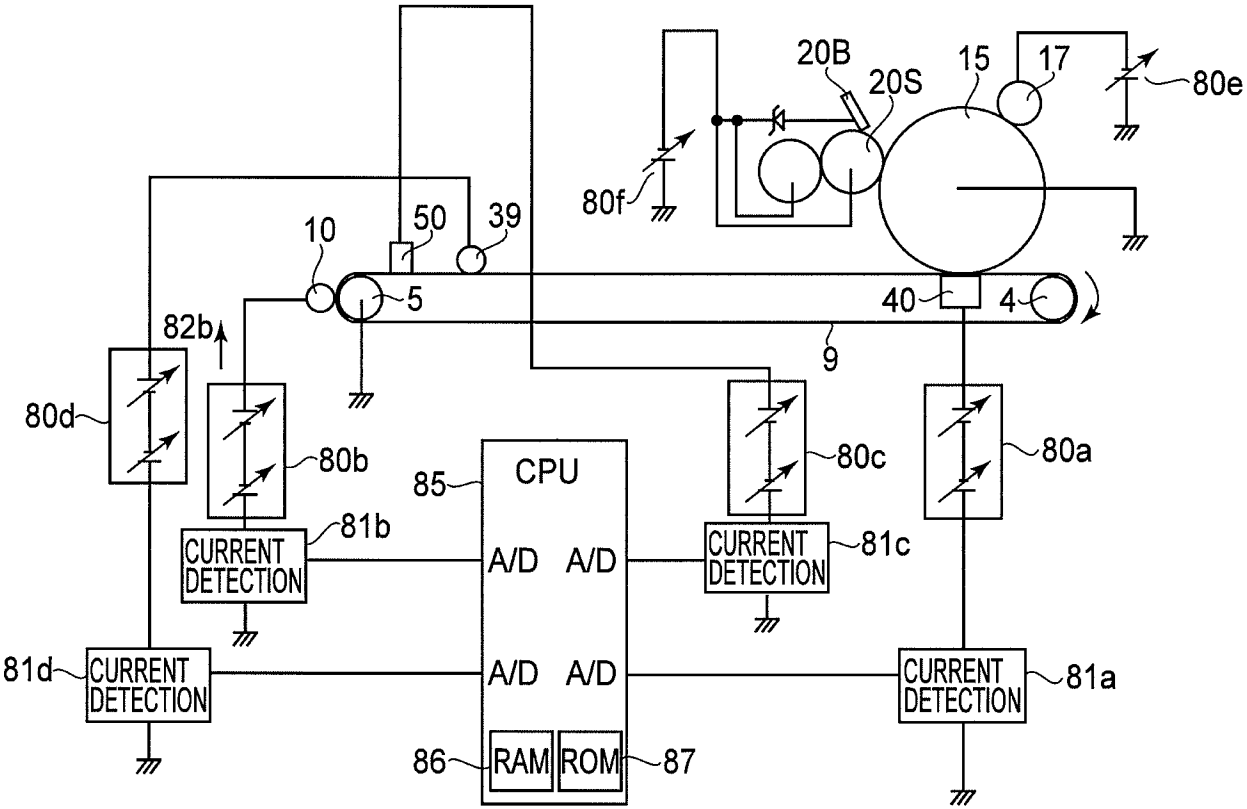
FIG. 2A is a schematic view showing a circuit structure of a voltage source of the image forming apparatus.

FIG. 2A is a schematic view showing a circuit structure of a voltage source which is a voltage applying unit of the image forming apparatus. A charging voltage source 80*e* is provided for the charging roller 17, a developing blade voltage source 80*f* is provided for the developing roller 20S and the developing blade 20B, and a primary transfer voltage source 80*a* is provided for a primary transfer member 40. Further, a secondary transfer voltage source 70*b* is provided for the secondary transfer roller 10, an ICL brush voltage source 80 is provided for the ICL brush 50, and an ICL roller voltage source 80*d* is provided for the ICL roller 39, so that the voltages are supplied to the respective members to which the voltages are to be applied. Further, as needed, a current detecting circuit is provided independently for each of the voltage sources and on the basis of a result of the current detection, the image forming apparatus effects constant current control or constant voltage control with respective to each voltage source. In FIG. 2A, four voltage sources consisting of the primary transfer voltage source 80*a*, the secondary transfer voltage source 80*b*, the ICL brush voltage source 80*c* and the ICL roller voltage source 80*d* are provided with current detecting circuits 81*a*, 81*b*, 81*c* and 81*d*, respectively. For example, as shown in FIG. 2A, a secondary transfer current 82*b* flows from the secondary transfer voltage source 80*b* along a path in the order of the secondary transfer roller 10, the intermediary transfer belt 9, the secondary transfer opposite roller 5 and the ground (GND). Therefore, the current detecting circuit 81*b* provided between the secondary transfer voltage source 80*b* and the GND can detect a current amount of the secondary transfer current 82*b*. The current detecting circuit 81*b* converts the detected current amount of the secondary transfer current 82*b* into a corresponding voltage signal and thereafter sends the voltage signal to an A/D port of a CPU 85.

The CPU 85 which is a control portion is a one-chip microcomputer for controlling an output voltage and the like of the secondary transfer voltage source 80*b* on the bias of a voltage signal from the current detecting circuit 81*b*, environmental information of the image forming apparatus, lifetime information of the intermediary transfer belt and the like, etc., and incorporates therein RAM 86 and ROM 87 which are a storing device. In the ROM 87, a program and various data for controlling the image forming operation of the image forming apparatus are stored. The RAM 86 is used for computation of data necessary to controlling the image forming operation of the image forming apparatus or for temporary storing and the like. Further, the CPU 85 includes a timer used for time measurement or the like.

FIG. 2B is a schematic view showing a circuit structure of the current detecting circuit 81*b*, and other current detecting circuits 81*a*, 81*c* and 81*d* also have the same circuit structure. As shown in FIG. 2B, a current Ir flowing into a combined resistor R111 of the secondary transfer roller 10, the intermediary transfer belt 9 and the secondary transfer opposite roller 5 by applying the voltage from the secondary transfer voltage source 80*b* passes through a resistor R112 and is returned to the voltage source. At this time, the current detecting circuit 81*b* notifies the CPU 85, as a voltage signal, of a detected voltage Vr which is the sum of a potential difference, between terminals of a resistance R112, varying depending on the current amount of the current Ir, and a reference voltage Vk which is generated from a power source Vcc by potential division of resistors R113 and R114. The CPU 85 detects a current value of the current Ir from the voltage signal received from the current detecting circuit 81*b*, thus developing a contact/separation state between the secondary transfer roller 10 and the intermediary transfer belt 9.

Embodiment 1

In this embodiment, the above-described circuit structure of the voltage source (FIG. 2A) and the current detecting circuit (FIG. 2B) are used. Incidentally, portions identical to those in the above-described constitution are represented by the same numerals or symbols and will be omitted from description.

Figure 3:
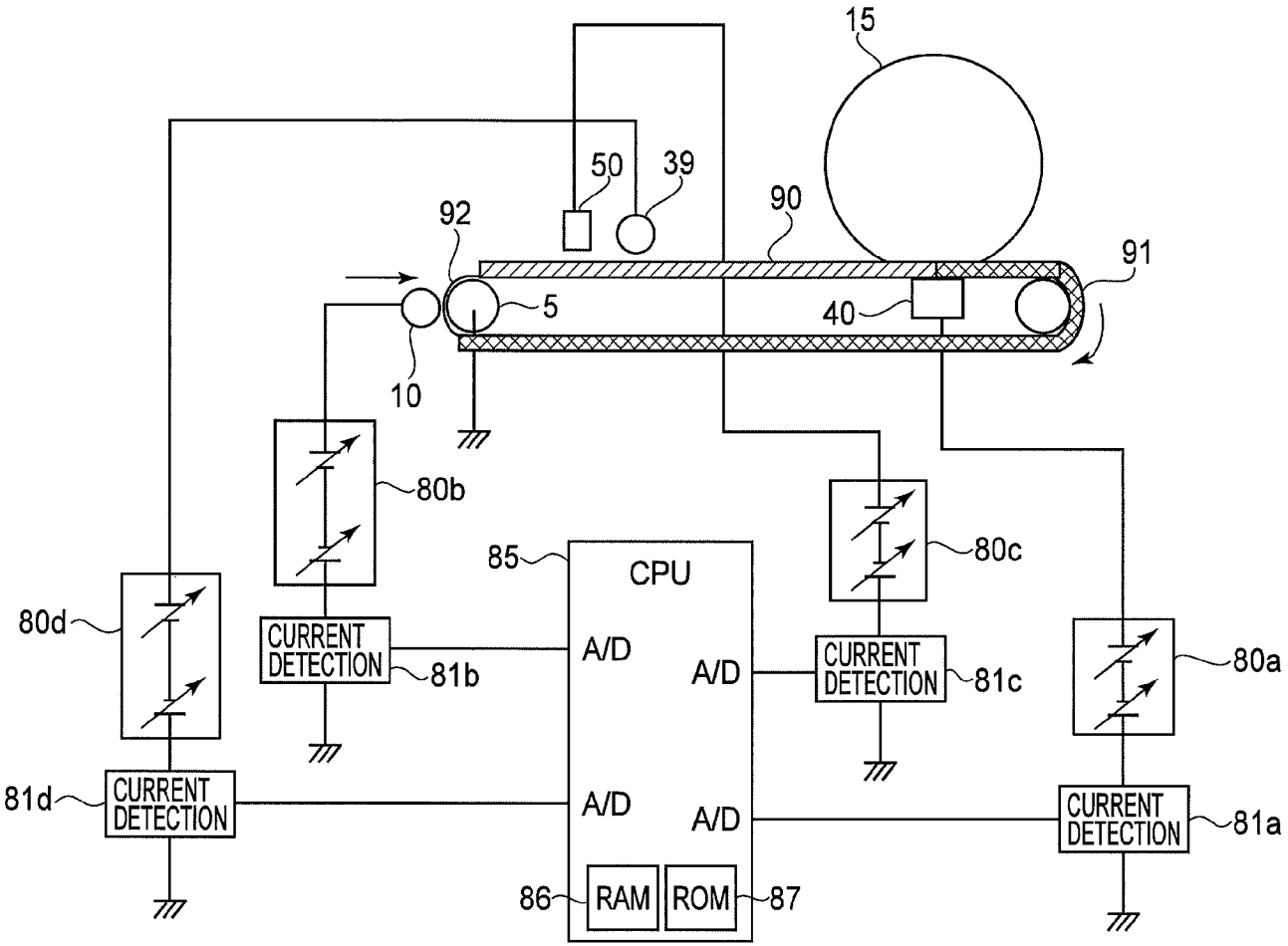
FIG. 3 is a schematic view showing a contact secondary transfer between an intermediary transfer belt and a secondary transfer roller in Embodiment 1.

FIG. 3 is a schematic view showing a contact state between the secondary transfer roller 10 and the intermediary transfer belt 9 in this embodiment. In the case where the secondary transfer roller 10 is contacted to the intermediary transfer belt 9 and the color image on the intermediary transfer belt 9 is transferred onto the recording material 2, as shown in FIG. 3, the secondary transfer roller 10 is required to be contacted to the non-image region 92. The non-image region 92 is located between a trailing (rear) end of an image region 90 and a leading (front) end of an image region 91 and is a region in which the color image is not primary-transferred at all. The non-image region 92 can be formed by making a circumferential length of the intermediary transfer belt 9 longer than a length of the recording material having a maximum size applicable to the present invention.

Further, when the secondary transfer roller 10 can be always contacted to a position just behind the trailing end 90 of the image region, there is no need to increase the length of the non-image region in consideration of the variation until the contact of the secondary transfer roller 10 is completed, so that it becomes possible to minimize the circumferential length of the intermediary transfer belt 9.

Figure 4:
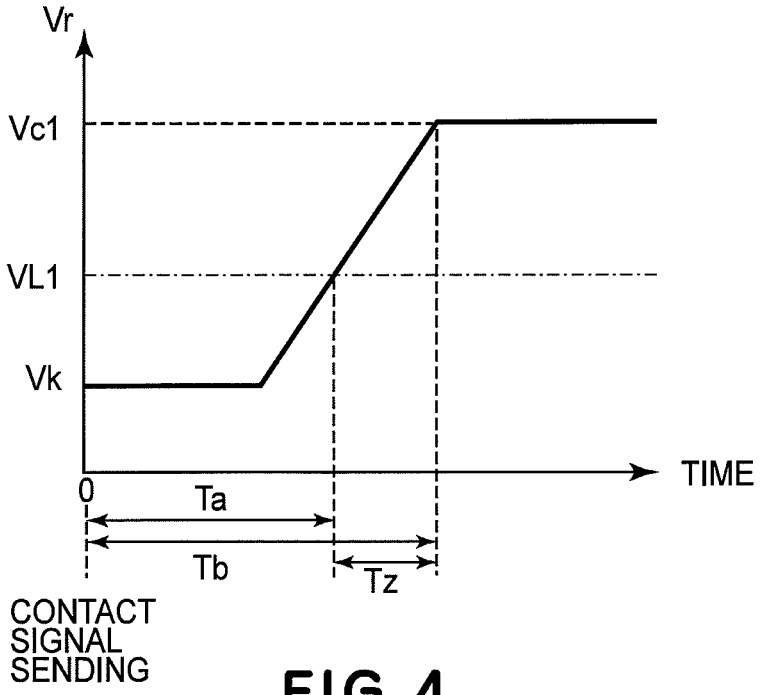
FIG. 4 is a graph showing a change in detected voltage when the secondary transfer roller is contacted to the intermediary transfer belt in Embodiment 1.

FIG. 4 is a graph showing a change of the detected voltage Vr when the secondary transfer roller 10 is moved from the separated state and is contacted to the intermediary transfer belt 9 in the state in which an initial voltage V0 is applied to the secondary transfer roller 10. In FIG. 4, an abscissa represents the time and an ordinate represents the detected voltage Vr as the voltage value which is detected in the current detecting circuit 81*b* and is notified to the CPU 85. The initial voltage V0 is a voltage value which is lower than an applied voltage (transfer voltage) during normal transfer. With reference to FIG. 4, a calculating method of the time required for the contact of the secondary transfer roller 10 in this embodiment (hereinafter referred to as a "contact time") will be described.

As described above, in the case where the secondary transfer roller 10 is in the separated state, the detected voltage Vr is the reference voltage Vk which is generated from the power source voltage Vcc by potential division of the resistors R113 and R114. When the secondary transfer roller 10 is contacted to the intermediary transfer belt 9, the current passes through the secondary transfer roller 10, the intermediary transfer belt 9, the secondary transfer opposite roller 5 and the GND, so that the detected voltage Vr is changed to a voltage Vc1 which is the sum of the reference voltage Vk and the potential difference between the terminals of the resistor R112. The detected voltage Vr crosses a threshold voltage VL1 until it reaches the voltage Vc1 from the voltage Vk. A time from sending, by the CPU 85, of an instruction signal for the contact of the secondary transfer roller 10 to the intermediary transfer belt 9 (hereinafter referred to as a "contact instruction signal") to the crossing of the detected voltage Vr with the threshold voltage VL1 is taken as Ta. In FIG. 4, the contact instruction signal is sent at the time 0. The threshold voltage VL1 refers to the voltage value detected in the current detecting circuit 81*b* when the secondary transfer roller 10 is contacted to the intermediary transfer belt 9 and is stored in advance, in ROM 87, as a reference voltage value by which the CPU 85 judges the contact state. Further, a time from the sending of the contact instruction signal by the CPU 85 to detection of the voltage Vc1 at the time when the secondary transfer roller 10 is contacted to the intermediary transfer belt 9 with reliability is taken as Tb. Incidentally, of the time required for the contact, a time variation due to the above-described contact mechanism of the secondary transfer roller 10 by the cam member 77 is sufficiently larger than a time difference Tz between the times Ta and Tb and therefore the time Tb can be regarded as being approximately equal to the time Ta. From the above, by obtaining the time from the contact instruction signal sending until the secondary transfer roller 10 is contacted to the intermediary transfer belt 9, it is possible to calculate the contact time of the secondary transfer roller 10 including the time variation due to the contact mechanism. Further, although the time difference between the times Ta and Tb is very small, the time required from the contact instruction signal sending to the contact of the secondary transfer roller 10 is calculated by adding a predetermined time difference Tz, which has been measured in advance, to the time Ta, so that calculation accuracy can be further improved.

The image forming apparatus is capable of executing an operation in a measuring mode in which the contact time of the secondary transfer roller 10 is detected.

Figure 5:
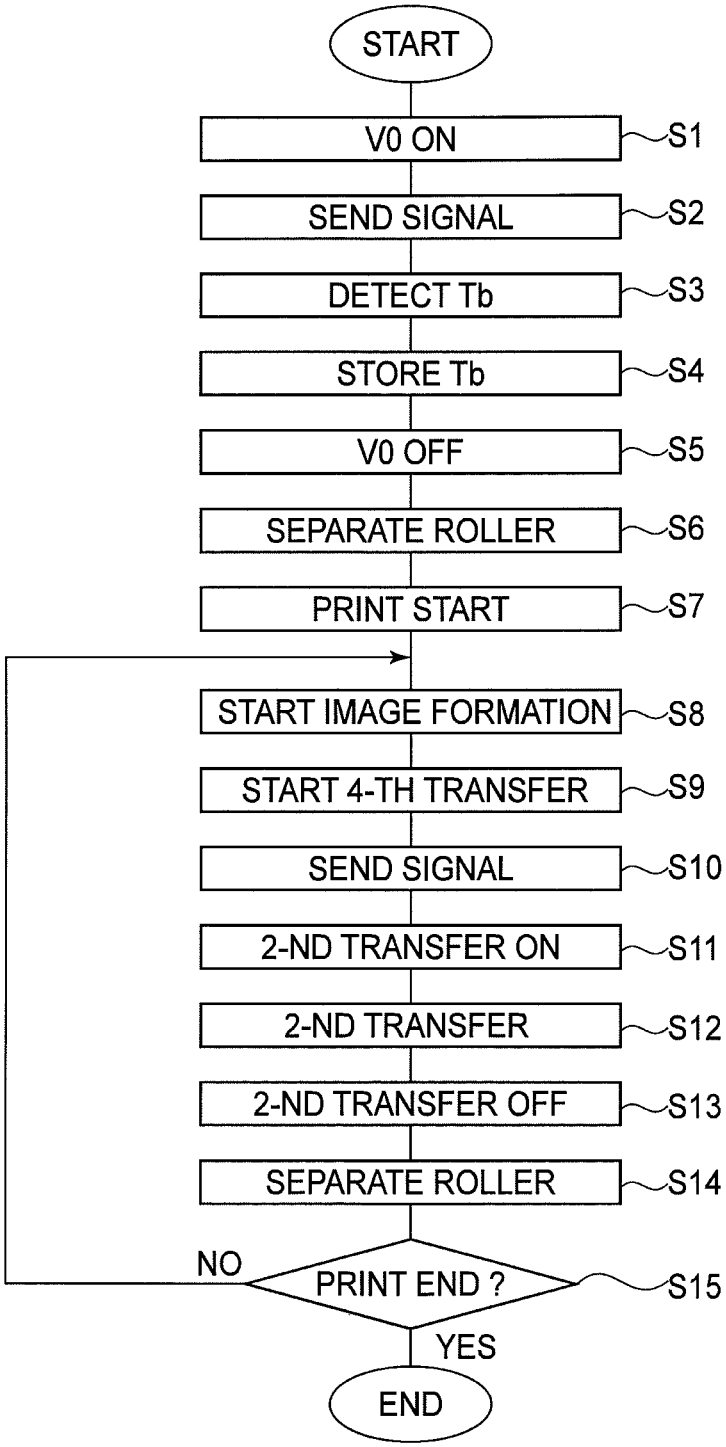
FIG. 5 is a flow chart showing contact time measurement and contact operation control of the secondary transfer roller in Embodiment 1.

FIG. 5 is a flow chart showing a measuring procedure of the contact time of the secondary transfer 10 and a contact operation control procedure in this embodiment. These procedures are executed by the CPU 85 on the basis of programs stored in ROM 87 which is a memory. At the time of start of the flow chart in FIG. 5, the secondary transfer roller 10 is in the separated state from the intermediary transfer belt 9. The CPU 85 provides an instruction to the secondary transfer voltage source 80*b* so as to apply the initial voltage V0 (step 1 (S1)). The CPU 85 sends the contact instruction signal of the secondary transfer roller 10 and at the same time starts a timer therein in order to measure the contact time (S2). The CPU 85 monitors, in order to detect that the secondary transfer roller 10 is contacted to the intermediary transfer, belt 9 with reliability, whether or not the voltage value of the detected voltage Vr notified from the current detecting circuit 81*b* reaches the voltage Vc1. When the reaching of the detected voltage Vr to the voltage Vc1 is detected, the CPU 85 stops the time measurement by the timer and determines a timer value at that time as the time Tb from the contact instruction signal sending until the secondary transfer roller 10 is contacted to the intermediary transfer belt 9 with reliability (S3). The CPU 85 stores the contact time Tb, detected in S3, in RAM 86 which is a memory (S4). The CPU 85 provides an instruction of the off of the initial voltage V0 to the secondary transfer voltage source 80*b* (S5) and separates the secondary transfer roller 10 (S6). In the measuring mode, the persuader from S1 to S6 is executed.

In accordance with a print start instruction (ST), the CPU 85 starts image formation from the charging to the primary transfer via the development (S8). The CPU 85 starts the timer when start of the primary transfer for the third color is detected, and then monitors start of the primary transfer for the fourth color in order to calculate timing of the contact instruction signal sending (S9). When the start of the primary transfer for the fourth color is detected (S9), the CPU 85 reads out speed information of the intermediary transfer belt 9 stored in the ROM 87 and reads out the contact time Tb of the secondary transfer roller 10 stored in the RAM 86. Then, the CPU 85 calculates timing of the sending of the contact instruction signal from the speed information of the intermediary transfer belt 9 and the contact time Tb of the secondary transfer roller 10 so that the secondary transfer roller 10 is contacted to the intermediary transfer belt 9 immediately after passing of the trailing end of the third color image on the intermediary transfer belt 9. The CPU 85 is the control portion for effecting control so that the contact member is contacted to or separated from the intermediary transfer member. Further, the CPU 85 checks, by the timer from the start of the primary transfer for the third color, whether or not the time reaches the contact instruction signal sending timing, and when the time reaches the sending timing, the CPU 85 sends the contact instruction signal. Further, in order to monitor the reaching of the time to voltage-on timing, the CPU 85 initializes (resets) the timer and then the time measurement is started again (S10). The CPU 85 turns on (applies) the secondary transfer voltage when the lapse of the time Tb required from the contact instruction signal sending to the contact of the secondary transfer roller 10 is detected through the timer (S11). The secondary transfer voltage application start timing is also determined on the basis of the time Tb. By determining the secondary transfer voltage application start timing on the basis of the time Tb, the secondary transfer application start timing can be regarded as the timing when the secondary transfer roller 10 is contacted to the intermediary transfer belt 9.

The image on the intermediary transfer belt 9 is secondary-transferred under application of the secondary transfer voltage (S12). After the completion of the secondary transfer, the CPU 85 provides an instruction of turning-off of the secondary transfer voltage to the secondary transfer voltage source 80*b* (S13) and then separates the secondary transfer roller 10 from the intermediary transfer belt 9 (S14). The CPU 85 repeats, in the case where there is the recording material 2 to be subjected to the printing, the operations in S8 to S14 for image formation again (S15). Incidentally, with respect to the operations in S1 to S6 in the measuring mode, the operations may also be performed, in addition to every execution of the print start instruction, e.g., when the power source of the image forming apparatus is turned on or when an environmental condition such as an ambient temperature or an ambient humidity is changed.

As described above, according to this embodiment, it becomes possible to eliminate the influence the variation in contact time of the secondary transfer roller 10 generated every image forming apparatus on the circumferential length of the intermediary transfer belt 9 and thereby to minimize the circumferential belt length. As a result, it is possible to realize cost reduction and main assembly size reduction. As a result, by knowing the contact time of the secondary transfer roller 10, it becomes possible to perform rise of the secondary transfer voltage immediately after the secondary transfer roller 10 is contacted to the intermediary transfer belt 9. As a result, it is possible to prevent the influence of a loss of the rise time of the secondary transfer, voltage and voltage noise on other systems. Further, in this embodiment, the procedure with respect to the secondary transfer roller 10 as an example of the contact member is described but the present invention is not limited thereto. For example, also with respect to the ICL brush 50 and the ICL roller 39, a similar effect can be obtained by providing the current detecting circuits 81*c* and 81*d* and by adapting the procedure shown in the flow chart of FIG. 5 to the ICL brush 50 and the ICL roller 39.

Embodiment 2

In Embodiment 1, the image forming apparatus provided with the current detecting circuits independently for the respective voltage sources was described. In this embodiment, an image forming apparatus in which commonalty of the voltage sources and the current detecting circuits in Embodiment 1 are provided will be described.

Figure 6B:
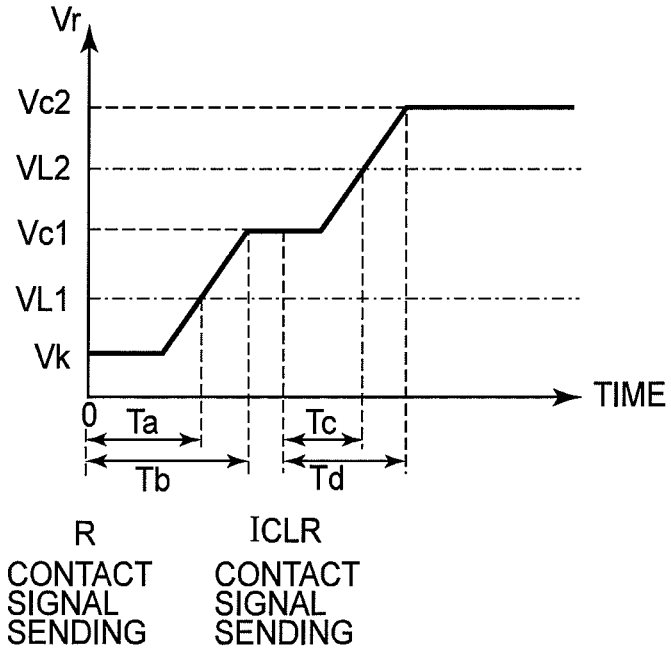
FIG. 6B is a graph showing a change in detected voltage when a secondary transfer roller and an ICL roller are contacted to an intermediary transfer belt in Embodiment 2.
Figure 6A:
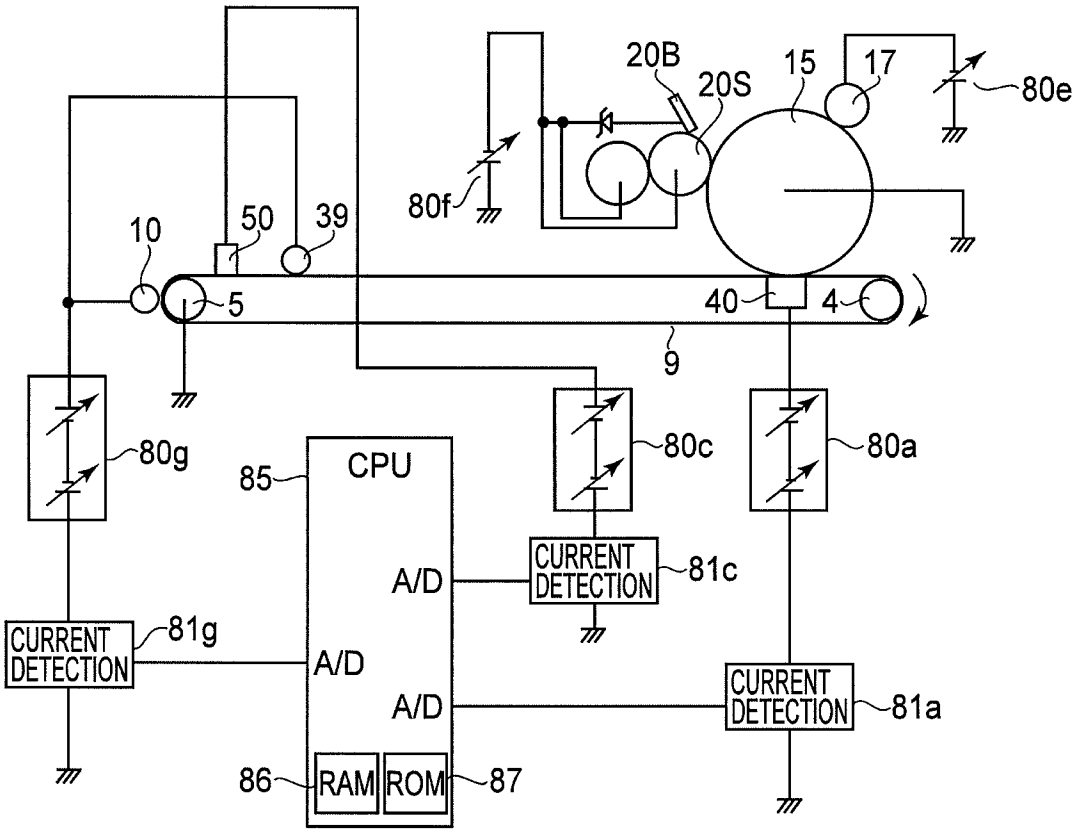
FIG. 6A is a circuit structure view of a voltage source in Embodiment 2.

FIG. 6A is a schematic view showing a circuit structure of the voltage source in this embodiment. In this embodiment, a point that a common voltage source 80*g* and a common current detecting circuit 81*g* are provided with respect to the secondary transfer roller 10 and the ICL roller 39 is different in constitution from Embodiment 1 but other portions of the circuit structure are similar to those shown in FIG. 2A. Further, the circuit structure of the current detecting circuit 81*g* is also similar to that shown in FIG. 2B.

FIG. 6B is a graph showing a change of the detected voltage Vr when the secondary transfer roller 10 is moved from the separated state and is contacted to the intermediary transfer belt 9 and then the ICL roller 39 is contacted to the intermediary transfer belt 9 in the state in which a common initial voltage V0 is applied to the secondary transfer roller 10. In FIG. 6B, an abscissa represents the time and an ordinate represents the detected voltage Vr as the voltage value which is detected in the current detecting circuit 81*g* and is notified to the CPU 85. The initial voltage V0 is a voltage value which is lower than an applied voltage (transfer voltage) during normal transfer in order to reduce the influence of the noise on other systems. With reference to FIG. 6B, a calculating method of the contact time of the secondary transfer roller 10 and the ICL roller 39 in this embodiment will be described.

As described in Embodiment 1, in the case where the secondary transfer roller 10 is in the separated state from the intermediary transfer belt 9, the detected voltage Vr is the reference voltage Vk which is generated from the power source voltage Vcc by potential division of the resistors R113 and R114. When the secondary transfer roller 10 is contacted to the intermediary transfer belt 9, the current passes through the secondary transfer roller 10, the intermediary transfer belt 9, the secondary transfer opposite roller 5 and the GND, so that the detected voltage Vr is changed to a voltage Vc1 which is the sum of the reference voltage Vk and the potential difference between the terminals of the resistor R112. Further, when the ICL roller 39 is contacted to the intermediary transfer belt 9, the current passes through the ICL roller 39, the intermediary transfer belt 9, the secondary transfer opposite roller 5 and the GND, so that the detected voltage Vr is changed to a voltage Vc2 which is the sum of the reference voltage Vk and the potential difference between the terminals of the resistor R112. The detected voltage Vr crosses a threshold voltage VL1 until it reaches the voltage Vc1 from the voltage Vk. A time from sending, by the CPU 85, of an instruction signal for the contact of the secondary transfer roller 10 to the intermediary transfer belt 9 (hereinafter referred to as a "transfer R contact instruction signal") to the crossing of the detected voltage Vr with the threshold voltage VL1 is taken as Ta. In FIG. 6B, the transfer R contact instruction signal is sent at the time 0. Further, the detected voltage Vr crosses a threshold voltage VL2 until it reaches the voltage Vc2 from the voltage Vc1. A time from sending, by the CPU 85, of an instruction signal for the contact of the ICL roller 39 to the intermediary transfer belt 9 (hereinafter referred to as a "ICLR contact instruction signal") to the crossing of the detected voltage Vr with the threshold voltage VL2 is taken as Tc. In FIG. 6B, the ICLR contact instruction signal is sent after the detected voltage Vr reaches the voltage Vc1. The threshold voltage VL2 refers to the voltage value detected in the current detecting circuit 81*g* when the ICL roller 39 is contacted to the intermediary transfer belt 9 and is stored in advance, in ROM 87, as a reference voltage value by which the CPU 85 judges the contact state. Further, a time from the transfer R contact instruction signal until the secondary transfer roller 10 is contacted to the intermediary transfer belt 9 with reliability is taken as Tb, and a time from the ICLR contact instruction signal until the ICL roller 39 is contacted to the intermediary transfer belt 9 with reliability is taken as Td. Incidentally, as described in Embodiment 1, the time Tb can be regarded as being approximately equal to the time Ta. The ICL roller 39 also includes the same contact mechanism as that of the secondary transfer roller 10, and a time variation due to the above-described contact mechanism of the secondary transfer roller 10 by the cam member 77 is sufficiently larger than a time difference between the times Tc and Td and therefore the time Td can be regarded as being approximately equal to the time Tc. From the above, by obtaining the time from the transfer R contact instruction signal sending until the contact of the secondary transfer roller 10 and the time from the ICLR contact instruction signal sending until the contact of the ICL roller 39, it is possible to calculate the contact time of the secondary transfer roller 10 including the time variation due to the contact mechanism. Further, similarly as in Embodiment 1, when the time difference between the contact times Ta and Tb of the secondary transfer roller 10 and the time difference between the contact times Tc and Td of the ICL roller 39 are taken into consideration in advance and then contact timing of the secondary transfer roller 10 and the ICL roller 39 is determined, calculation accuracy can be further improved.

[Contact Time Measuring Procedure and Contact Operation Control Procedure of Secondary Transfer Roller and ICL Roller]

Figure 7:
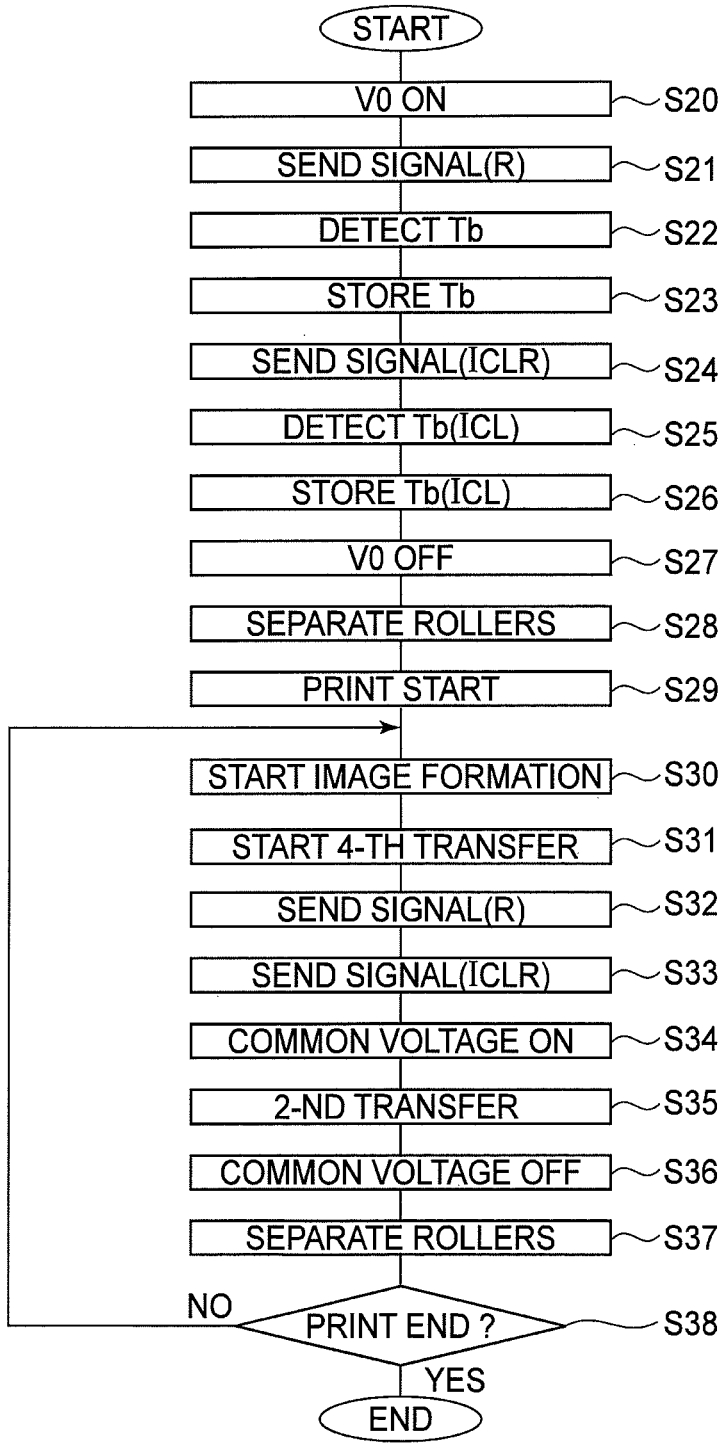
FIG. 7 is a flow chart showing contact time measurement and contact operation control of the secondary transfer roller and the ICL roller in Embodiment 2.

FIG. 7 is a flow chart showing a measuring procedure of the contact time of the secondary transfer 10 and the ICL roller 39 and a contact operation control procedure of these rollers in this embodiment. These procedures are executed by the CPU 85 on the basis of programs stored in the ROM 87. At the time of start of the flow chart in FIG. 5, the secondary transfer roller 10 and the ICL roller 39 are in the separated state from the intermediary transfer belt 9. The CPU 85 provides an instruction to the common voltage source 80*g* so as to apply the common initial voltage V0 (S20). The CPU 85 sends the transfer R contact instruction signal of the secondary transfer roller 10 and at the same time starts a timer therein in order to measure the contact time (S21). The CPU 85 monitors, in order to detect that the secondary transfer roller 10 is contacted to the intermediary transfer belt 9 with reliability, whether or not the voltage value of the detected voltage Vr notified from the current detecting circuit 81*g* reaches the voltage Vc1. When the reaching of the detected voltage Vr to the voltage Vc1 is detected, the CPU 85 stops the timer and determines a timer value at that time as the time Tb from the transfer R contact instruction signal sending until the secondary transfer roller 10 is contacted to the intermediary transfer belt 9 with reliability (S22). The CPU 85 stores the contact time Tb, detected in S22, in RAM 86 which is a memory (S23). Then, the CPU 85 initializes the timer and sends the ICLR contact instruction signal of the ICL roller 39 and at the same time starts the timer again in order to measure the contact time (S24). The CPU 85 monitors, in order to detect that the ICL roller 39 is contacted to the intermediary transfer belt 9 with reliability, whether or not the voltage value of the detected voltage Vr notified from the current detecting circuit 81*g* reaches the voltage Vc2. When the reaching of the detected voltage Vr to the voltage Vc2 is detected, the CPU 85 stops the timer and determines a timer value at that time as the time Td from the ICLR contact instruction signal sending until the ICL roller 39 is contacted to the intermediary transfer belt 9 with reliability (S25). The CPU 85 stores the contact time Td, detected in S25, in the RAM 86 (S26). The CPU 85 provides an instruction of the off of the common initial voltage V0 to the common voltage source 80*g* (S27) and separates the secondary transfer roller 10 and the ICL roller 39 (S28).

In accordance with a print start instruction (S29), the CPU 85 starts image formation from the charging to the primary transfer via the development (S30). The CPU 85 starts the timer when start of the primary transfer for the third color is detected, and then monitors start of the primary transfer for the fourth color in order to calculate timing of the contact instruction signal sending (S31). When the start of the primary transfer for the fourth color is detected (S31), the CPU 85 reads out speed information of the intermediary transfer belt 9 stored in the ROM 87 and reads out the contact time Tb of the secondary transfer roller 10 and the contact time Td of the ICL roller 39 which are stored in the RAM 86. Then, the CPU 85 calculates timing of simultaneous contact of the secondary transfer roller 10, and the ICL roller 39 immediately after passing of the trailing end of the third color image on the intermediary transfer belt 9, through the contact position with the ICL roller 39. The CPU 85 calculates its timing on the basis of the speed information of the intermediary transfer belt 9, the contact time Tb of the secondary transfer roller 10 and the contact time Td of the ICL roller 39. Then, the CPU 85 checks, by the timer, whether or not the time from the primary transfer start of the third color image reaches the transfer R contact instruction signal sending timing from a calculate result, and when the time reaches the sending timing, the CPU 85 sends the transfer R contact instruction signal (S32). Similarly, the CPU 85 checks, by the timer from the start of the primary transfer for the third color, whether or not the time reaches the ICLR contact instruction signal sending timing, and when the time reaches the sending timing, the CPU 85 sends the ICLR contact instruction signal. Further, in order to monitor the reaching of the time to the common initial voltage-on timing, the CPU 85 initializes (resets) the timer and then the timer is started again (S33). The CPU 85 turns on (applies) the common initial voltage when the lapse of the time Td required from the ICLR contact instruction signal sending to the contact of the ICR roller 39 is detected through the timer (S334). The image on the intermediary transfer belt 9 is secondary-transferred, and the residual toner on the intermediary transfer belt 9 is charged to the opposite polarity by the ICL roller 39 and then is collected as waste toner (S35). After the completion of the secondary transfer, the CPU 85 provides an instruction of turning-off of the common voltage to the common voltage source 80*g* (S36) and then separates the secondary transfer roller 10 and the ICL roller 39 from the intermediary transfer belt 9 (S37). The CPU 85 repeats, in the case where there is the recording material 2 to be subjected to the printing, the operations in S30 to S37 for image formation again (S38).

Incidentally, in this embodiment, in consideration of the commonalty of the voltage source and the influence on other system when the voltage is applied before the contact, the non-image region on the intermediary transfer belt 9 at least has a length between the contact position of the ICL roller 39 and the contact position of the secondary transfer roller 10. As described above, the non-image region of the intermediary transfer belt 9 refers to the region from the trailing end of the image region to the leading end of the subsequent image region. Further, in FIG. 7, the CPU 85 sends the ICLR contact instruction signal after the sending of the transfer R contact instruction signal but the sending order of these contact instruction signals is reversed when the contact time Td is shorter than the contact time Tb. Incidentally, with respect to S20 to S28, the processing is not performed every execution of the print start instruction but may also be performed, e.g., when the power source of the image forming apparatus is turned on or when an environmental condition such as an ambient temperature or an ambient humidity is changed.

As described above, according to this embodiment, it becomes possible to eliminate the influence the variation in contact time of the secondary transfer roller 10 and the ICL roller 39 generated every image forming apparatus on the circumferential length of the intermediary transfer belt 9 and thereby to minimize the circumferential belt length. As a result, it is possible to realize cost reduction and main assembly size reduction. As a result, by knowing the contact time of the ICL roller 39, it is possible to simultaneously perform rise of the ICL roller voltage and the secondary transfer voltage immediately after the ICL roller 39 is contacted to the intermediary transfer belt 9 and therefore, it is possible to prevent the influence of a loss of the rise time and noise on other systems. Further, even when the common voltage is applied to the secondary transfer roller 10 before the ICL roller 39 is contacted to the intermediary transfer belt 9, if there is no influence of the noise from the ICL roller 39 on other systems, the length of the non-image region on the intermediary transfer belt 9 can be further shortened and as a result, the circumferential belt length is also shortened.

In this embodiment, the example in which the commonalty of the voltage source for the secondary transfer roller 10 and the ICL roller 39 is provided is described but a similar effect can be obtained also with respect to a combination of the secondary transfer roller 10 and the ICL brush 50.

Embodiment 3

An image forming apparatus in this embodiment has the same constitution as that of the image forming apparatus in Embodiment 1 except for the voltage application start timing with respect to the contact member. The circuit structure of the voltage source, the current detecting circuit, and the contact time measuring procedure and the contact operation procedure are based on those shown in FIG. 2A, FIG. 2B and FIG. 5, respectively.

First, similarly as in Embodiment 1, by executing the operations in the measuring mode of S1 to S6, the CPU 85 which is the control portion calculates the contact time of the secondary transfer roller 10 to the intermediary transfer belt 9. A shortest time, necessary for the voltage rise, calculated from a time constant or the like of the system is stored as the secondary transfer voltage rise time in the ROM 87 in advance. In Embodiment 1, the CPU 85 effected the voltage rise after the secondary transfer roller 10 is contacted to the intermediary transfer belt 9 with reliability. In this embodiment, the secondary transfer voltage rise is started before the secondary transfer roller 10 is contacted to the intermediary transfer belt 9 with reliability. However, the secondary transfer roller 10 is contacted to the intermediary transfer belt 9 during a low-voltage state which is an intermediate state of the rise of the secondary transfer voltage, i.e., in a state in which the voltage value is lower them that when the secondary transfer roller 10 is used in the normal transfer. This is effected in order to prevent the influence of the voltage noise on other systems. Further, when a shortest time of the rise of the secondary transfer voltage is taken as T1 and a time from the contact instruction signal sending to the contact of the secondary transfer roller 10 is taken as T2, the rise of the secondary transfer voltage is started with timing T3 which satisfies: $(T2-T1)<T3<(T2+T1)$ from the time of the contact instruction signal sending.

From the above, the secondary transfer roller 10 can be contacted to the intermediary transfer belt 9 while being kept in the low-voltage state which is the intermediate state of the rise, so that the noise due to the voltage application can be alleviated and the circumferential length of the intermediary transfer belt 9 can be shortened. Further, as a result, it is possible to realize the cost reduction and the main assembly size reduction. Further, in this embodiment, the example in which the secondary transfer roller 10 is used as the contact member is described but a similar effect can be obtained also in the case where the ICL brush 50 or the ICL roller 39 is used as the contact member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 122726/2010 filed May 28, 2010, which is hereby incorporated by reference.

What is claimed is:

1. An image forming apparatus comprising:

an image bearing member for bearing a toner image;

a rotatable intermediary transfer member onto which the toner image is to be primary-transferred from said image bearing member;

a contact member movable toward and away from said intermediary transfer member;

a voltage applying unit for applying a voltage to said contact member;

a current detecting circuit for detecting a current passing through said contact member to which the voltage is applied by said voltage applying unit; and a control portion for effecting control so that said contact member is in contact with or separated from said intermediary transfer member, wherein said control portion is capable of executing an operation in a measuring mode in which a contact time required to bring said contact member into contact with said intermediary transfer member is calculated by applying an initial voltage to said contact member, then by outputting a contact instruction signal to move said contact member from a separated state so as to be in contact with said intermediary transfer member, and then by measuring a time from output of the contact instruction signal until said current detecting circuit detects a predetermined current value.

2. The image forming apparatus according to claim 1, wherein said control portion outputs the contact instruction signal so that said contact member contacts to said intermediary transfer member immediately after a trailing end of an image formation region formed on said intermediary transfer member passes through a contact position of said contact member.

3. The image forming apparatus according to claim 1, wherein said contact member is a secondary transfer member for transferring the toner image from said intermediary transfer member onto a transfer material.

4. The image forming apparatus according to claim 1, wherein said control portion determines, after outputting the contact instruction signal, timing when said voltage applying unit starts application of a secondary transfer voltage on the basis of the contact time.

5. The image forming apparatus according to claim 4, wherein when a minimum time until the voltage applied by said voltage applying unit reaches the secondary transfer voltage is T1, the contact time is T2, and a time from the output of the contact instruction signal to start of rising of the secondary transfer voltage is T3, T3 satisfies the following formula:

$$(T2-T1)<T3<(T2+T1).$$

6. The image forming apparatus according to claim 4, wherein the initial voltage is lower than the secondary transfer voltage to be applied to said contact member by said voltage applying unit during image formation.

7. The image forming apparatus according to claim 1, wherein said contact member is a toner charging member for electrically charging residual toner on said intermediary transfer member.

8. The image forming apparatus according to claim 1, wherein said contact member includes a secondary transfer member for transferring the toner image from said intermediary transfer member onto a transfer material and includes a toner charging member for electrically charging residual toner on said intermediary transfer member, wherein said voltage applying unit is a common voltage applying unit for applying a common voltage to said secondary transfer member and said toner charging member, wherein said secondary transfer member contacts said intermediary transfer member and then said toner charging member contacts said intermediary transfer member.

9. The image forming apparatus according to claim 1, wherein said control portion brings, during image formation, said contact member into contact with a non-image region on said intermediary transfer member on the basis of the contact time.

10. An image forming apparatus comprising:

a rotatable member capable of bearing a toner image;

a contact member movable toward and away from said rotatable member;

a voltage applying unit for applying a voltage to said contact member;

a current detecting circuit for detecting a current passing through said contact member to which the voltage is applied by said voltage applying unit; and a control portion for effecting control so that said contact member is in contact with or separated from said rotatable member, wherein said control portion is capable of executing an operation in a mode in which the current detected by said current detecting circuit is changed by applying an initial voltage to said contact member, and then by moving said contact member from a separated state so as to contact said rotatable member.

11. The image forming apparatus according to claim 10, wherein said controller calculates a time, required to bring said contact member from the separated state into contact to said rotatable member, by executing the operation.

12. The image forming apparatus according to claim 10, wherein said contact member includes a transfer member for transferring the toner image from said rotatable member onto a transfer material and includes a toner charging member for electrically charging residual toner on said rotatable member, wherein said voltage applying unit is a common voltage applying unit for applying a common voltage to said transfer member and said toner charging member, wherein said transfer member contacts said rotatable member and then said toner charging member contacts said rotatable member.

* * * * *